US008168575B2

(12) United States Patent
Brutto et al.

(10) Patent No.: US 8,168,575 B2
(45) Date of Patent: May 1, 2012

(54) METALWORKING FLUIDS COMPRISING NEUTRALIZED FATTY ACIDS

(75) Inventors: Patrick E. Brutto, Bloomingdale, IL (US); Bonnie A. Pyzowski, Park Ridge, IL (US); Charles E. Coburn, Vernon Hills, IL (US)

(73) Assignee: Angus Chemical Company, Buffalo Grove, IL (US)

( * ) Notice: Subject to any disclaimer, the term of this patent is extended or adjusted under 35 U.S.C. 154(b) by 421 days.

(21) Appl. No.: 12/297,675

(22) PCT Filed: Apr. 26, 2007

(86) PCT No.: PCT/US2007/067462

§ 371 (c)(1),
(2), (4) Date: Oct. 20, 2008

(87) PCT Pub. No.: WO2007/130836

PCT Pub. Date: Nov. 15, 2007

(65) Prior Publication Data

US 2009/0170736 A1 Jul. 2, 2009

Related U.S. Application Data

(60) Provisional application No. 60/746,549, filed on May 5, 2006.

(51) Int. Cl.

| | |
|---|---|
| ***C10M 173/00*** | (2006.01) |
| ***C10M 173/02*** | (2006.01) |
| ***C07C 229/00*** | (2006.01) |

(52) U.S. Cl. ..... 508/527; 508/449; 554/108

(58) Field of Classification Search ..... 508/527, 508/449; 554/108

See application file for complete search history.

(56) References Cited

U.S. PATENT DOCUMENTS

| | | | | |
|---|---|---|---|---|
| 4,313,837 | A | 2/1982 | Vukasovich et al. | |
| 4,759,861 | A * | 7/1988 | Ogura et al. | 508/390 |
| 6,531,443 | B2 * | 3/2003 | Perella et al. | 510/501 |
| 2004/0248744 | A1 | 12/2004 | King et al. | |

FOREIGN PATENT DOCUMENTS

| | | | |
|---|---|---|---|
| GB | 2016516 A | * | 9/1979 |
| GB | 2044798 | | 10/1980 |

* cited by examiner

*Primary Examiner* — Walter D Griffin
*Assistant Examiner* — Vishal Vasisth
(74) *Attorney, Agent, or Firm* — Whyte Hirschboeck Dudek SC

(57) ABSTRACT

An additive for an aqueous metalworking fluid (MWF) comprises a C12-20 fatty acid neutralized with at least one of an amine, alkanolamine and a caustic. The additive is designed for use in an aqueous MWF having a pH of at least about 7 and comprising at least about 0.10 weight percent, based on the weight of the MWF, of the neutralized C12-20 fatty acid. The additive inhibits the staining of ferrous and nonferrous metals during and after machining.

9 Claims, 8 Drawing Sheets

METALWORKING FLUIDS COMPRISING NEUTRALIZED FATTY ACIDS

This application is a 371 of PCT/US07/67462, filed Apr. 26, 2007, which claims benefit of 60/746,549 filed May 5, 2006.

FIELD OF THE INVENTION

This invention relates to metalworking fluids. In one aspect, the invention relates to aqueous metalworking fluids (MWF) while in another aspect, the invention relates to aqueous MWF that inhibit the staining of aluminum and other metals. In yet another aspect, the invention relates to aqueous MWF that comprise neutralized fatty acids while in still another aspect, the invention relates to various methods of using the MWF.

BACKGROUND OF THE INVENTION

Aqueous metalworking fluids are well known and widely used because of their economic, environmental and safety advantages over nonaqueous metalworking fluids. Aqueous MWF have very low flammability and with the ever-increasing cost of petroleum-based products, their economic advantage over nonaqueous MWF continues to grow. Moreover, aqueous MWF do not carry the obvious environmental burden, at least to the same degree, of use and disposal that petroleum-based fluids carry. However, beyond these safety, economic and environmental advantages, aqueous MWF must also exhibit other properties, e.g., not stain the workpiece and stability during storage and use.

Aqueous MWF comprise mostly water, typically in excess of 95, often in excess of 97, weight percent (wt %). Water tends to stain certain ferrous and nonferrous workpieces, particularly aluminum, under typical metal working conditions, especially if the MWF has a relatively high pH, e.g., above 9, which is typical of many aqueous MWF. Certain materials, however, can be incorporated into the aqueous MWF to impede the staining of the workpiece, e.g., sodium silicate and phosphate esters, but these materials often have deficiencies of their own. For example, silicates tend to plug the ultra-filtration membranes frequently used in the recycling of the MWF, and phosphate esters are subject to relatively rapid bacterial degradation.

Accordingly, the metal working industry has a continuing interest in identifying additives and aqueous MWF formulations that reduce or eliminate the staining of a metal workpiece, particularly a nonferrous metal workpiece like aluminum, during and after a machining operation. Moreover, the industry, particularly small and medium size job shops, have a continuing interest in such additives and formulations that are effective on both ferrous and nonferrous metals because it allows them to avoid the need to purchase and inventory multiple aqueous MWF.

SUMMARY OF THE INVENTION

In one embodiment, the invention is a neutralized fatty acid additive for an aqueous MWF, the additive comprising a $C_{12-20}$ fatty acid neutralized with at least one of an amine, alkanolamine and a caustic. In another embodiment, the invention is an aqueous concentrate comprising the neutralized fatty acid additive. In still another embodiment, the invention is an aqueous MWF having a pH of at least about 7 and comprising at least about 0.1 wt %, based on the weight of the aqueous MWF, of a $C_{12-20}$ fatty acid neutralized with at least one of an amine, alkanolamine and a caustic.

As here used, "neutralized fatty acid additive", "fatty acid additive" and similar terms mean an essentially nonaqueous solution comprising essentially only the neutralized fatty acid. This is the form of the neutralized fatty acid if it is prepared apart from the remainder of the aqueous MWF. In this form, the additive can be packaged, stored and/or sold to distributors and/or end users.

"Concentrate", "masterbatch" and similar terms mean the neutralized fatty acid partially diluted with water, oil and/or another functional component of the aqueous MWF. "Partially diluted" means the concentrate requires further dilution, typically with water, before it is ready for use as an aqueous MWF. Typically, the concentrate comprises at least about 1, typically at least about 5 and occasionally as much as 10 or more, wt % of the neutralized fatty acid. The concentrate typically contains less than 95, more typically less than about 75 and even more typically less than about 50, wt % water. The concentrate can be made directly from the additive, e.g., diluting the additive with water and optionally adding other components of the MWF, or the concentrate can be made from scratch, e.g., the neutralized fatty acid is made in situ by the separate addition of the fatty acid and neutralizing agent. The concentrate, like the additive, can be packaged, stored and/or sold to distributors and/or end users.

"Aqueous MWF" and similar terms mean the MWF comprising all of its components and ready for use. In this form, the aqueous MWF is fully diluted, i.e., it does not require any further dilution with water or any other component before it is ready for use, and it typically comprises 95 or more weight percent water. Like the concentrate, it can be prepared either by dilution of its precursor (i.e., the concentrate, typically with a dilution factor between about ten and twenty, or more), or directly from the individual components. In this second method of preparation, the neutralized fatty acid can be added directly, i.e., as the previously prepared neutralized fatty acid additive, or it can be prepared in situ, i.e., the fatty acid and neutralizing agent can be added separately in their appropriate amounts.

"Neutralizing agent" and similar terms mean any amine, alkanolamine or caustic that is compatible with the other components of the MWF, and that can neutralized the fatty acid component of the MWF while retaining the substantial solubility of the neutralized fatty acid. "Substantial solubility" means that the any precipitation of the neutralized fatty acid is negligible in the context of its efficacy as a stain inhibiting component of the aqueous MWF.

In another embodiment, the invention is a method for machining or working a metal workpiece, the method comprising machining the workpiece using an aqueous MWF having a pH of at least about 7 and comprising at least about 0.1 wt %, based on the weight of the aqueous MWF, of a $C_{12-20}$ fatty acid neutralized with at least one of an amine, alkanolamine and a caustic. The aqueous MWF of this invention are used in the same manner as known aqueous MWF.

DESCRIPTION OF THE PREFERRED EMBODIMENTS

Figure 1:
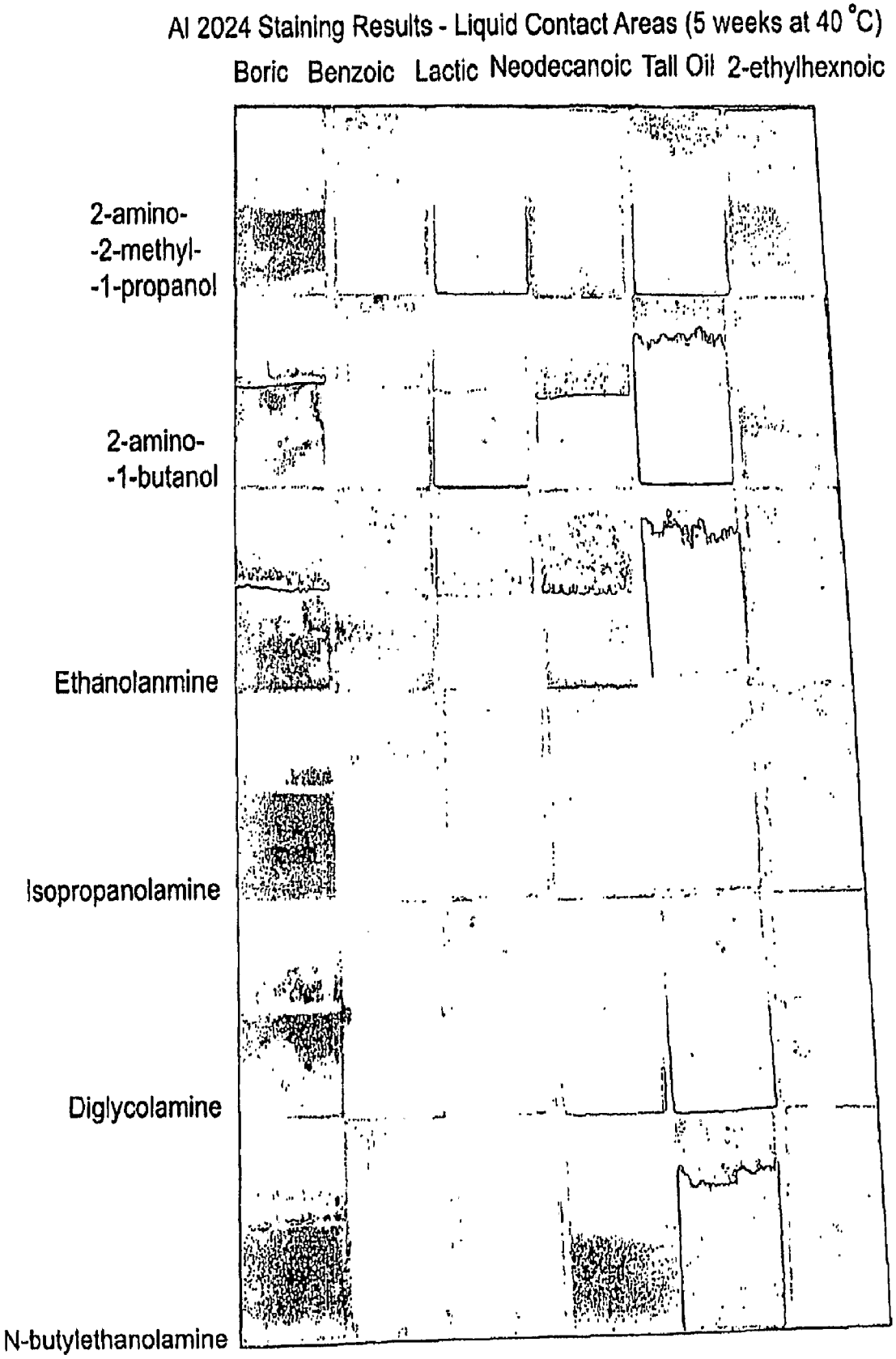
FIG. 1 shows the images of the Al 2024 aluminum alloy coupons reported in Table Ex. 2B.
Figure 2:
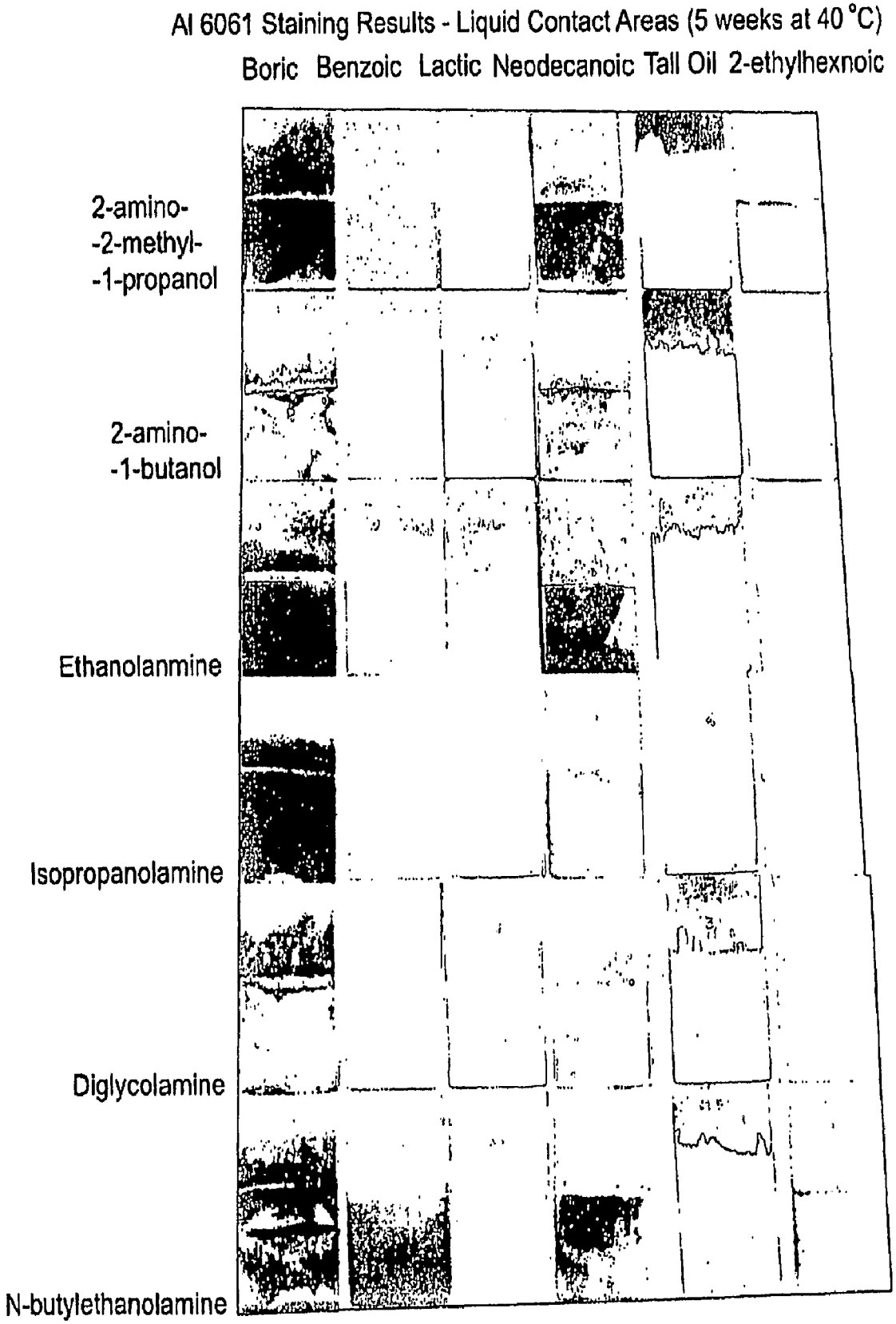
FIG. 2 shows the images of the Al 6061 aluminum alloy coupons reported in Table Ex. 2C.
Figure 3:
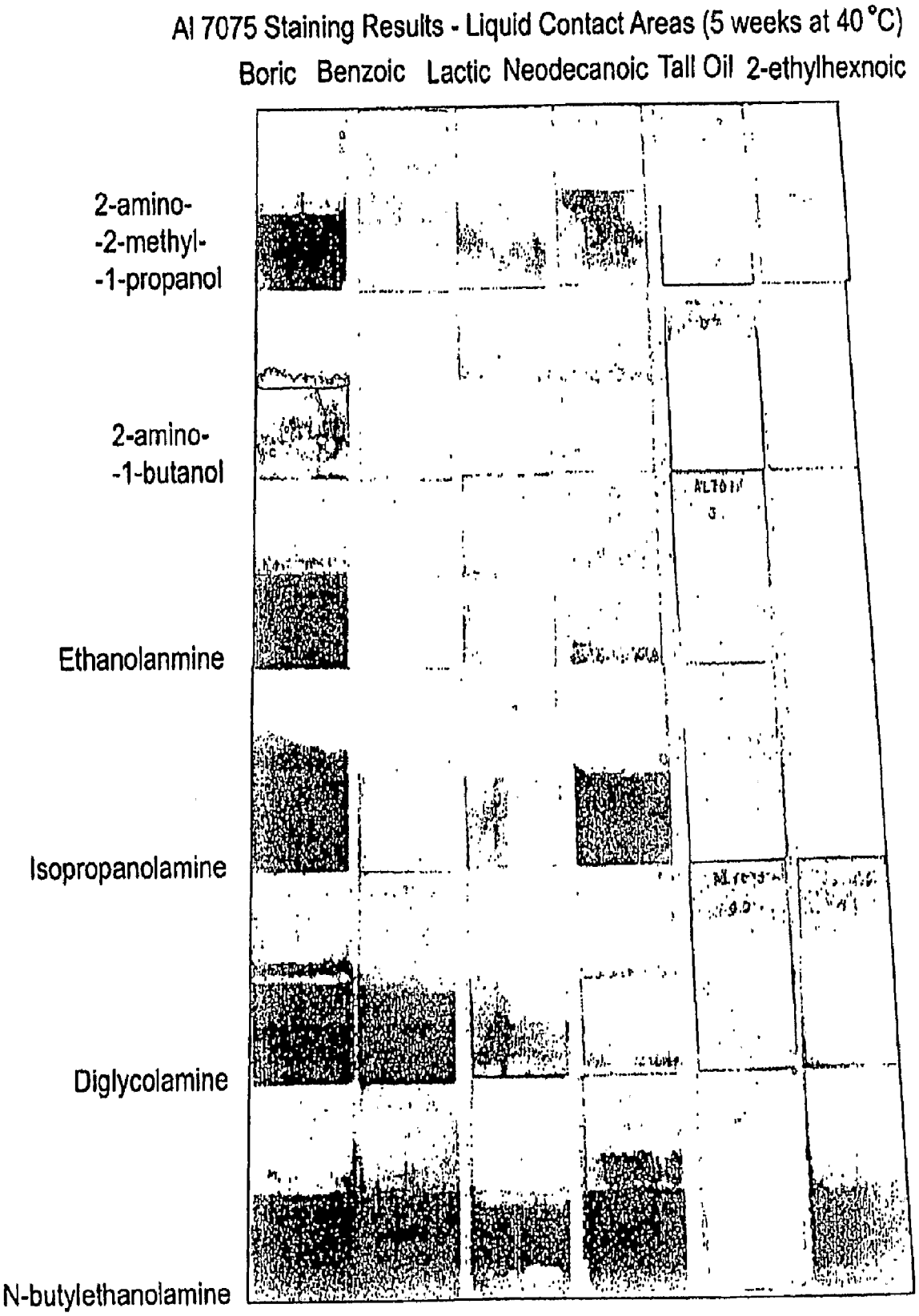
FIG. 3 shows the images of the Al 7075 aluminum alloy coupons reported in Table Ex. 2D.
Figure 4:
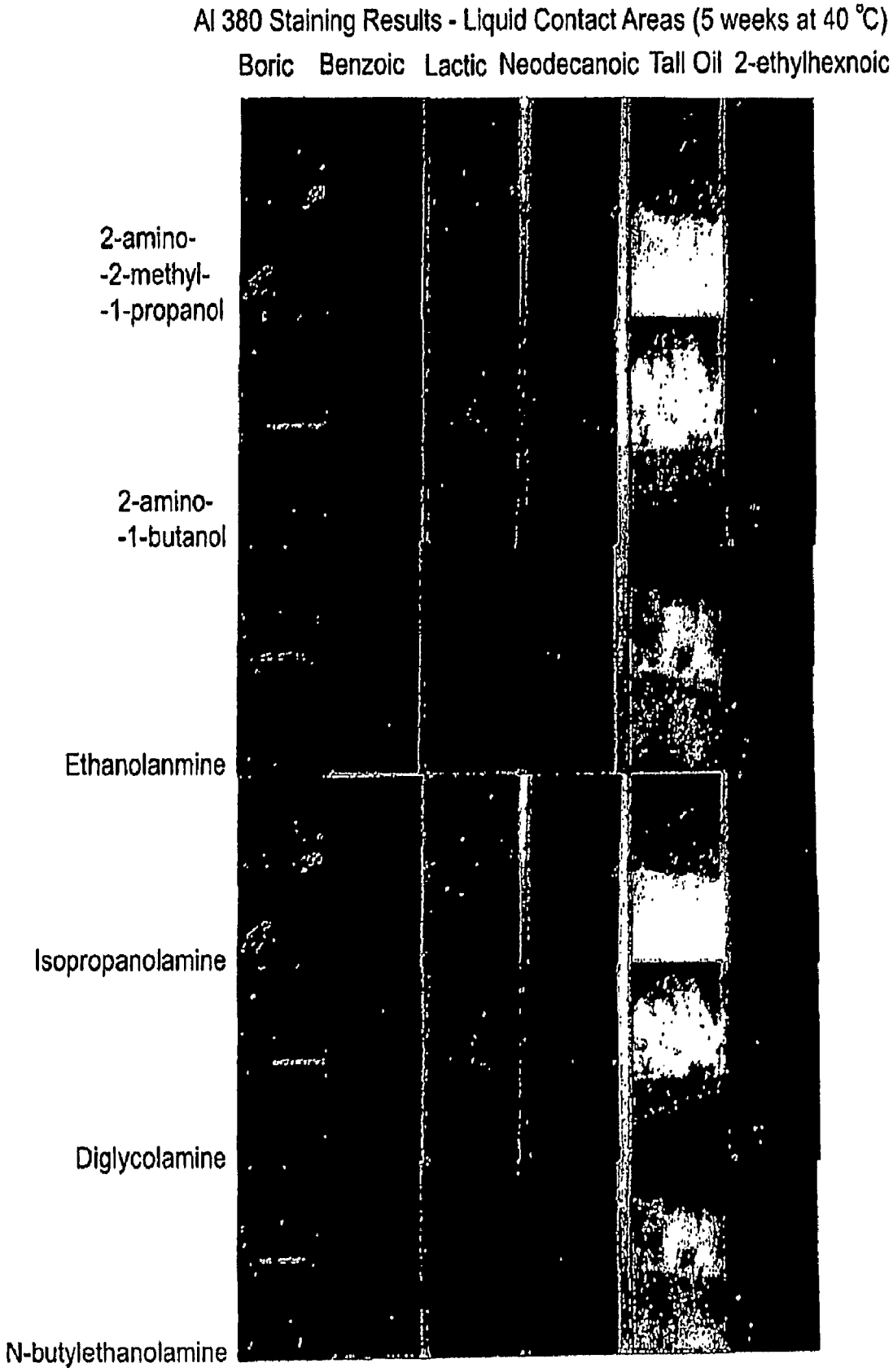
FIG. 4 shows the images of the Al 380 aluminum alloy coupons reported in Table Ex. 2E.

Any $C_{12-20}$ fatty acid that (i) is compatible with the other components of the aqueous MWF of which it is a component, (ii) can be neutralized by an amine, alkanolamine or caustic, and (iii) reduces or eliminates the staining of an aluminum workpiece while the workpiece is machined using the aqueous MWF, can be used in the practice of this invention. Typically, the fatty acid component of the aqueous MWF is of the general formula $$CH_3—(CH_2)_n—COOH$$

in which n is an integer of at least about 10, preferably at least about 12, more preferably at least about 14 and preferably not in excess of about 18, more preferably not in excess of about 16. The fatty acid can contain one or more sites of unsaturation, and/or one or more substituents that do not interfere to any significant extent with either the compatibility of the fatty acid with the other components of the MWF, if any, or that would impart a significant stain to the workpiece. Such substituents include aromatic, hydroxyl, sulfonate, halogen and ether groups. The structure of the fatty acid can be straight chain, branched or cyclic, and because branched fatty acids have fewer tendencies to foam than linear fatty acids, branched fatty acids are the preferred fatty acids of this invention. Neutralized, saturated, straight-chain fatty acids having a total carbon content of 18 or more are less favored than the other neutralized fatty acids that can be used in the practice of this invention because a greater amount of such fatty acids apparently are required to achieve the same level of stain inhibition as that provided by the other fatty acids, all else being equal.

Representative fatty acids that can be used in the practice of this invention include lauric acid, myristic acid, palmitic acid, 2-hexyldecanoic acid, stearic acid, oleic acid, linoleic acid, linolenic acid, arachidonic acid, ricinoleic acid, 2-cyclohexene-1-octanoic acid, 5-carboxy-4-hexyl-octanoic acid, chaulmoogric acid, isostearic acid (mixed isomers), cis-11-eicosenoic acid, phytanic acid, pristanic acid, 4,8,12-trimethyltridecanoic acid and tall oil fatty acid. The fatty acids can be used alone or in combination with two or more of each other. Commercially available $C_{12-20}$ fatty acids are often mixtures, and these mixtures may contain amounts of fatty acids with less than 12 carbon atoms and/or more than 20 carbon atoms. These mixtures can be used in the practice of this invention, and the amount of non-$C_{12-20}$ fatty acids in the mixture preferably are less than an inconsequential amount, e.g., less than about 10 weight percent of the total amount of fatty acids.

The neutralizing amine may be of any type and of any molecular weight, and can be used alone or in combination with one or more other amines, and/or in combination one or more alkanolamines and/or caustics. These amines comprise primary, secondary and tertiary amines, are either of aliphatic (preferably primary or tertiary alkyl), cycloaliphatic or aromatic structure, and can bear one or more substituents that do not interfere to any significant extent with either the compatibility of the amine with the other components of the MWF, if any, or that would impart a significant stain to the workpiece. Such substituents include ether groups. Representative amines include ammonia (considered an amine for purposes of this invention), methyl-, dimethyl- and trimethylamine, ethyl-, diethyl- and triethylamine, n-propyl-, di-n-propyl-, and tri-n-propylamine, isopropylamine, n-butyl-, isobutyl-, sec-butyl- and tert-butylamine, cyclohexylamine, dicyclohexylamine, benzylamine, α-phenylethylamine, β-phenylethylamine, ethylenediamine, tetramethylenediamine, hexamethylenediamine, tetra($C_{1-3}$ alkyl)ammonium hydroxide (e.g., tetra(methyl)ammonium hydroxide, tri(methyl)ethyl ammonium hydroxide, etc.), aniline, methylaniline, o-, m- and p-toluidine, o-, m- and p-anisidine, o-, m- and p-chloroaniline and benzidine.

Of particular interest and utility are the alkanolamines, particularly the alkanolamines with a lower molecular weight. Like the amine, the alkanolamine can be used alone or in combination with one or more other alkanolamines, and/or in combination with one or more amines and/or caustics. The alkanolamine can also bear one or more substituents that do not interfere to any significant extent with either the compatibility of the alkanolamine with the other components of the MWF, if any, or that would impart a significant stain to the workpiece. Representative alkanolamines include, mono-, di- and triethanolamine, mono-, di- and tri-isopropanolamine, diglycolamine, n-butylethanolamine, 2-amino-2-methyl-1-propanol (AMP), and 2-amino-2-ethyl-1,3-propanediol.

As used here, "caustic" includes any compound similar to sodium hydroxide, and that when combined with the fatty acid to form a fatty acid salt, the fatty acid salt is substantially soluble in the aqueous MWF. The caustic may be of any type, and can be used alone or in combination with one or more other caustics, and/or in combination one or more amines and/or alkanolamines. Representative caustics include sodium hydroxide, lithium hydroxide, potassium hydroxide, caustic alcohol (e.g., $C_2H_5ONa$), carbonates, phosphates and the like. Potassium hydroxide is a preferred caustic.

The fatty acid and amine, alkanolamine and/or caustic are used in such amounts that the fatty acid is effectively neutralized. The molar ratio of neutralizing groups to carboxyl groups is typically about 1:1 although some benefit of the invention can be obtained using a slightly lower or higher ratio. An excess of neutralizing agent can be used, but it is without any significant beneficial effect.

In one embodiment of the invention, the neutralized fatty acid is prepared apart from the MWF, and then packaged and sold as an additive for use in the preparation of various concentrate and/or aqueous MWF formulations. In this embodiment, the fatty acid and neutralizing agent are mixed in any convenient manner, typically with agitation under ambient conditions. In other embodiments, the neutralized fatty acid can be diluted with water and/or blended with other components of the concentrate and/or aqueous MWF before packaging and/or use.

In another embodiment, the neutralized fatty acid is prepared as part of the process of preparing the aqueous MWF, either prior to its addition to the aqueous medium of the MWF or in situ. Regardless of the method of its preparation, the amount of neutralized fatty acid in the aqueous MWF is typically at least about 0.1, preferably at least about 0.4 and more preferably at least about 0.07, wt % of the aqueous MWF. The maximum amount of neutralized fatty acid in the aqueous MWF can vary widely and is usually a function of economics. Typically, the maximum amount does not exceed about 1, preferably it does not exceed about 0.7 and more preferably it does not exceed about 0.5, wt % of the aqueous MWF.

The aqueous MWF of this invention can comprise simply water and a neutralized fatty acid, but typically comprises a number of other components as well. These other components can include, but are not limited to hydrocarbon and/or synthetic oils, various inorganic salts, surface active agents, biocides, lubricants, dyes, de-foamers, emulsifiers and the like. These other components are used in known amounts and combinations, and the aqueous MWF typically comprises at least about 95 or more wt % water, either tap or de-ionized water. The neutralized fatty acids used in the practice of this invention are matched to the other components of the aqueous MWF formulation to maximize the desired performance.

The aqueous MWF of this invention are suitable for use with both ferrous metals, e.g., iron, steel and galvanized steel, and nonferrous metals, e.g., aluminum and aluminum alloys. The metal workpieces are machined in known and conventional manners, and the aqueous MWF of this invention are used in known and conventional ways.

In the following examples, all parts and percentages are by weight unless otherwise indicated.

SPECIFIC EMBODIMENTS

Example 1

The tall oil fatty acid salt of 2-amino-2-methyl-1-propanol (AMP) was used in a staining test. For this test 33.5 g of a 1% aqueous solution of 95% AMP in de-ionized water was added to 300 g of 0.27% tall oil fatty acid in Chicago, Ill. tap water. The resulting 0.34% tall oil fatty acid-AMP salt solution was placed into glass jars, and coupons of aluminum alloys Al 2024, Al 380 (a cast aluminum), Al 6061 and Al 7075 (both air craft grade aluminums) were half-immersed in the solutions. Controls were prepared using plain tap water and de-ionized water adjusted to pH 9.5 with potassium hydroxide. The jars were sealed under air and placed into a 40° C. oven. Coupons were removed and examined for staining after 24 hours, 1 week and 5 weeks. Staining in the vapor phase was reduced in some cases relative to the control systems. For all alloys except Al 380, staining was essentially eliminated in the liquid phase; light staining occurred with Al 380 but this was far less than that experienced by the controls.

Example 2

The salt solutions reported in Table Ex. 2A were prepared in Chicago tap water, with the neutralizing agent levels adjusted to achieve a pH of 9.0. In this example, only the neutralized tall oil is representative of the invention.

TABLE EX. 2A

| Weight % Salt in Solution (pH 9.0) | | | | | | |
|---|---|---|---|---|---|---|
| | Boric | Benzoic | Lactic | Neodecanoic | Tall Oil | 2-ethylhexanoic |
| 2-amino-2-methyl-1-propanol | 0.4 | 0.15 | 0.46 | 0.40 | 0.33 | 0.42 |
| 2-amino-1-butanol | 0.39 | 0.46 | 0.47 | 0.40 | 0.33 | 0.43 |
| Ethanolamine | 0.34 | 0.39 | 0.39 | 0.34 | 0.30 | 0.36 |
| Isopropanolamine | 0.37 | 0.42 | 0.42 | 0.38 | 0.32 | 0.39 |
| Diglycolamine | 0.42 | 0.50 | 0.50 | 0.42 | 0.34 | 0.45 |
| N-butylethanolamine | 0.43 | 0.50 | 0.51 | 0.43 | 0.35 | 0.46 |

The results of staining tests with the above salt solutions using the protocol described in Example 1 are shown in Tables Ex. 2B-E below. Although the degree of staining, e.g., dark, medium, light, very light and none, are subjective, images of the test coupons are provided in FIGS. 1-4. The acceptability of a reported degree of staining on a particular workpiece is subjective with the user of the workpiece. For purposes of these examples, acceptable staining was light, very light or none.

TABLE EX. 2B

| Al 2024 Staining Results - Liquid Contact Areas (5 weeks at 40° C.) | | | | | | |
|---|---|---|---|---|---|---|
| | Boric | Benzoic | Lactic | Neodecanoic | Tall Oil | 2-ethylhexanoic |
| 2-amino-2-methyl-1-propanol | Dark | Medium | Light | Dark | None | Dark |
| 2-amino-1-butanol | Dark | Medium | Light | Dark | None | Dark |
| Ethanolamine | Dark | Medium | Light | Dark | None | Dark |
| Isopropanolamine | Dark | Medium | Light | Dark | None | Dark |
| Diglycolamine | Dark | Medium | Light | Dark | None | Dark |
| N-butylethanolamine | Dark | Medium | Light | Dark | None | Dark |

TABLE EX. 2C

| Al 6061 Staining Results - Liquid Contact Areas (5 weeks at 40° C.) | | | | | | |
|---|---|---|---|---|---|---|
| | Boric | Benzoic | Lactic | Neodecanoic | Tall Oil | 2-ethylhexanoic |
| 2-amino-2-methyl-1-propanol | Dark | Medium | Medium | Medium | None | Dark |
| 2-amino-1-butanol | Dark | Medium | Medium | Dark | None | Dark |
| Ethanolamine | Dark | Medium | Medium | Medium | None | Dark |
| Isopropanolamine | Dark | Medium | Medium | Medium | None | Dark |
| Diglycolamine | Dark | Medium | Medium | Medium | None | Dark |
| N-butylethanolamine | Dark | Medium | Medium | Medium | None | Dark |

TABLE EX. 2D

| Al 7075 Staining Results - Liquid Contact Areas (5 weeks at 40° C.) | | | | | | |
|---|---|---|---|---|---|---|
| | Boric | Benzoic | Lactic | Neodecanoic | Tall Oil | 2-ethylhexanoic |
| 2-amino-2-methyl-1-propanol | Dark | Medium | Medium | Dark | None | Medium |
| 2-amino-1-butanol | Dark | Medium | Medium | Dark | None | Medium |
| Ethanolamine | Dark | Medium | Medium | Dark | None | Medium |
| Isopropanolamine | Dark | Medium | Medium | Dark | None | Medium |
| Diglycolamine | Dark | Medium | Medium | Dark | None | Medium |
| N-butylethanolamine | Dark | Medium | Medium | Dark | None | Medium |

TABLE EX. 2E

| Al 380 Staining Results - Liquid Contact Areas (5 weeks at 40° C.) | | | | | | |
|---|---|---|---|---|---|---|
| | Boric | Benzoic | Lactic | Neodecanoic | Tall Oil | 2-ethylhexanoic |
| 2-amino-2-methyl-1-propanol | Dark | Dark | Dark | Dark | Very Light | Dark |
| 2-amino-1-butanol | Dark | Dark | Dark | Dark | Very Light | Dark |
| Ethanolamine | Dark | Dark | Dark | Dark | Very Light | Dark |
| Isopropanolamine | Dark | Dark | Dark | Dark | Very Light | Dark |
| Diglycolamine | Dark | Dark | Dark | Dark | Very Light | Dark |
| N-butylethanolamine | Dark | Dark | Dark | Dark | Very Light | Dark |

Example 3

Figure 5A:
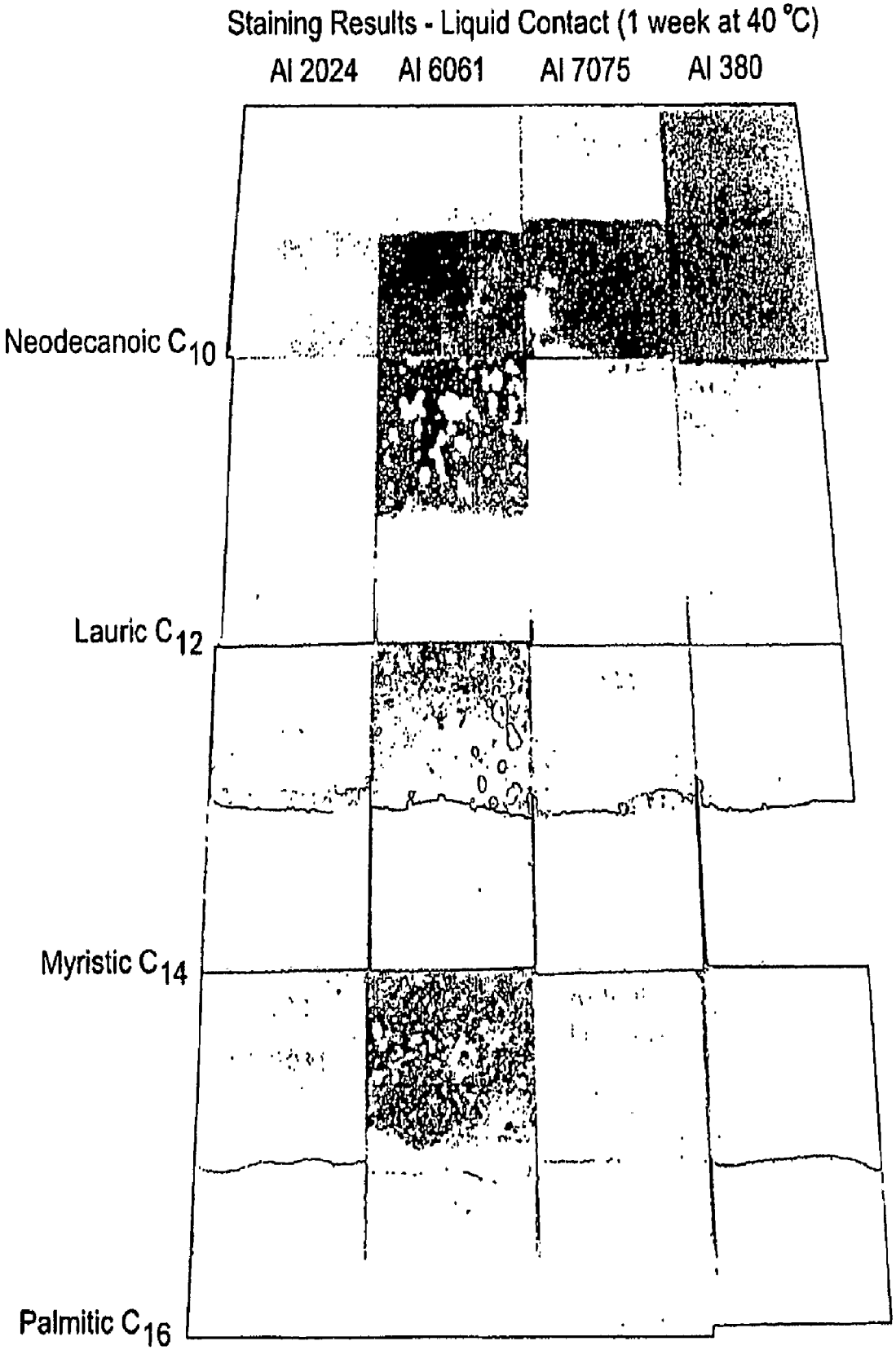
FIGS. 5A and 5B show the images of the aluminum alloy coupons reported in Table Ex. 3.
Figure 5B:
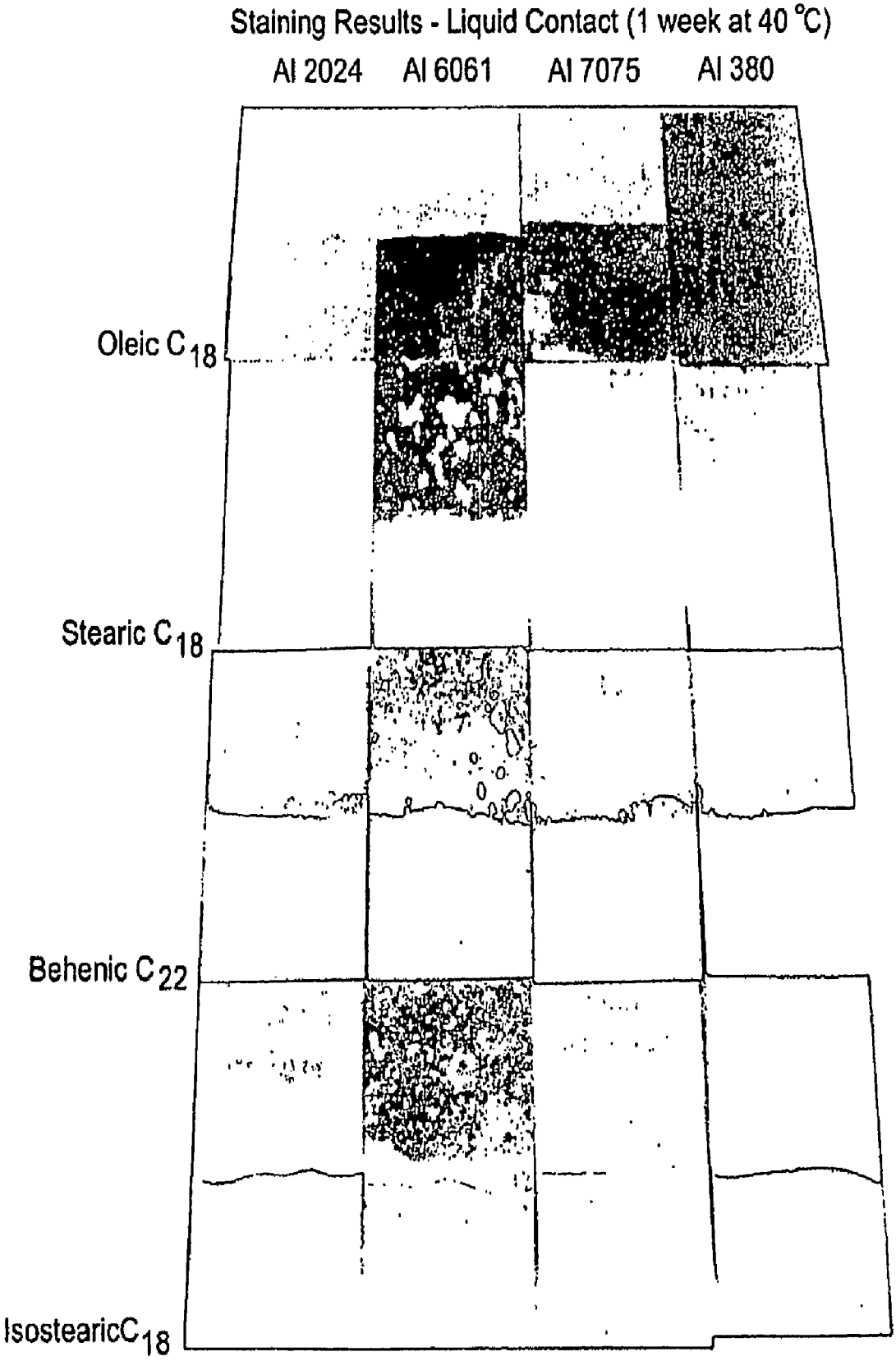

In order to determine the effect of chain length on the efficacy of fatty acid alkanolamines as stain inhibitors, salts ranging from neodecanoic (see Example 2 above, a 10-carbon branched chain monocarboxylic acid), up to behenic (a 22-carbon straight-chain monocarboxylic acid) were evaluated. The results for 0.3% acids (or 0.4% in the case of neodecanoic) neutralized in tap water with 2-amino-2-methyl-1-propanol to pH 9.5 are reported in Table Ex. 3 below and FIGS. 5A-B.

TABLE EX. 3

| Staining Results - Liquid Contact - 1 Week at 40° C. | | | | |
|---|---|---|---|---|
| Fatty Acid | Al 2024 | Al 6061 | Al 7075 | Al 380 |
| Neodecanoic $C_{10}$ | Dark | Dark | Medium | Dark |
| Lauric $C_{12}$ | None | None | None | None |
| Myristic $C_{14}$ | None | None | None | None |
| Palmitic $C_{16}$ | None | None | None | None |
| Oleic $C_{18}$ | None | None | None | None |

TABLE EX. 3-continued

| Staining Results - Liquid Contact - 1 Week at 40° C. | | | | |
|---|---|---|---|---|
| Fatty Acid | Al 2024 | Al 6061 | Al 7075 | Al 380 |
| Stearic $C_{18}$ | Dark | Dark | Dark | Dark |
| Behenic $C_{22}$ | Dark | Dark | Dark | Dark |
| Isostearic $C_{18}$ | None | None | None | None |

These data demonstrate that chain length has an effect on performance (likely due in part to the solubility/dispersability of the salt). The stearic and behenic salts are less dispersible in water than the others, and this may affect the amount of salt available to wet the metal surface. More stearic acid is likely required to achieve acceptable results in this particular experiment. The lack of efficacy of the neodecanoate salt is unexplained, but it may have to do with its higher solubility in water as compared to $C_{12-20}$ acid salts.

Example 4

To demonstrate the reduced foaming tendency of branched fatty acid salts (as opposed to straight chain fatty acid salts), a generic synthetic aqueous MWF was prepared using Chicago tap water (20 parts water to 1 part concentrate). The synthetic MWF formulation comprised the following components:

| Components | Wt % |
|---|---|
| Deionized water | 74 |
| Amine Dicarboxylate Salt | 10 |
| Inversely Soluble Fatty Ester | 5 |
| 2-Amino-2-Methyl-1-Propanol | 2 |
| Triethanolamine | 8 |
| Bicyclic Oxazolidine Biocide | 1 |

The diluted base fluid was divided into four equal parts, and to three parts was added 0.1 wt % of the acid salts identified in Table Ex. 4 below. Exactly 50 milliliters (ml) of diluted fluid were placed in 100 ml stoppered graduated cylinders. The cylinders were then shaken for one minute and evaluated for initial foam volume (time equal to 0 minute) and then at selected times subsequently. The data in Table Ex. 4 shows that the initial foam collapsed faster in those fluids comprising a branched fatty acid salt than in those fluids comprising a straight chain fatty acid salt.

TABLE EX. 4

Foaming for Synthetic MWF

| Time (min) | Base Fluid (Control, Foam Ht in ml) | Base Fluid plus 0.1 wt % Isostearic/AMP (Foam Ht in ml) | Base Fluid plus 0.1 wt % 2-hexyl-deconanoic/AMP (Foam Ht in ml) | Base Fluid plus 0.1 wt % Tall Oil/AMP (Foam Ht in ml) |
|---|---|---|---|---|
| 0 | 50 | 40 | 50 | 50+ |
| 1 | 35 | 36 | 45 | 45 |
| 2 | 15 | 35 | 40 | 45 |
| 5 | 5 | 20 | 20 | 45 |
| 15 | 3 | 3 | 5 | 20 |

Example 5

Figure 6:
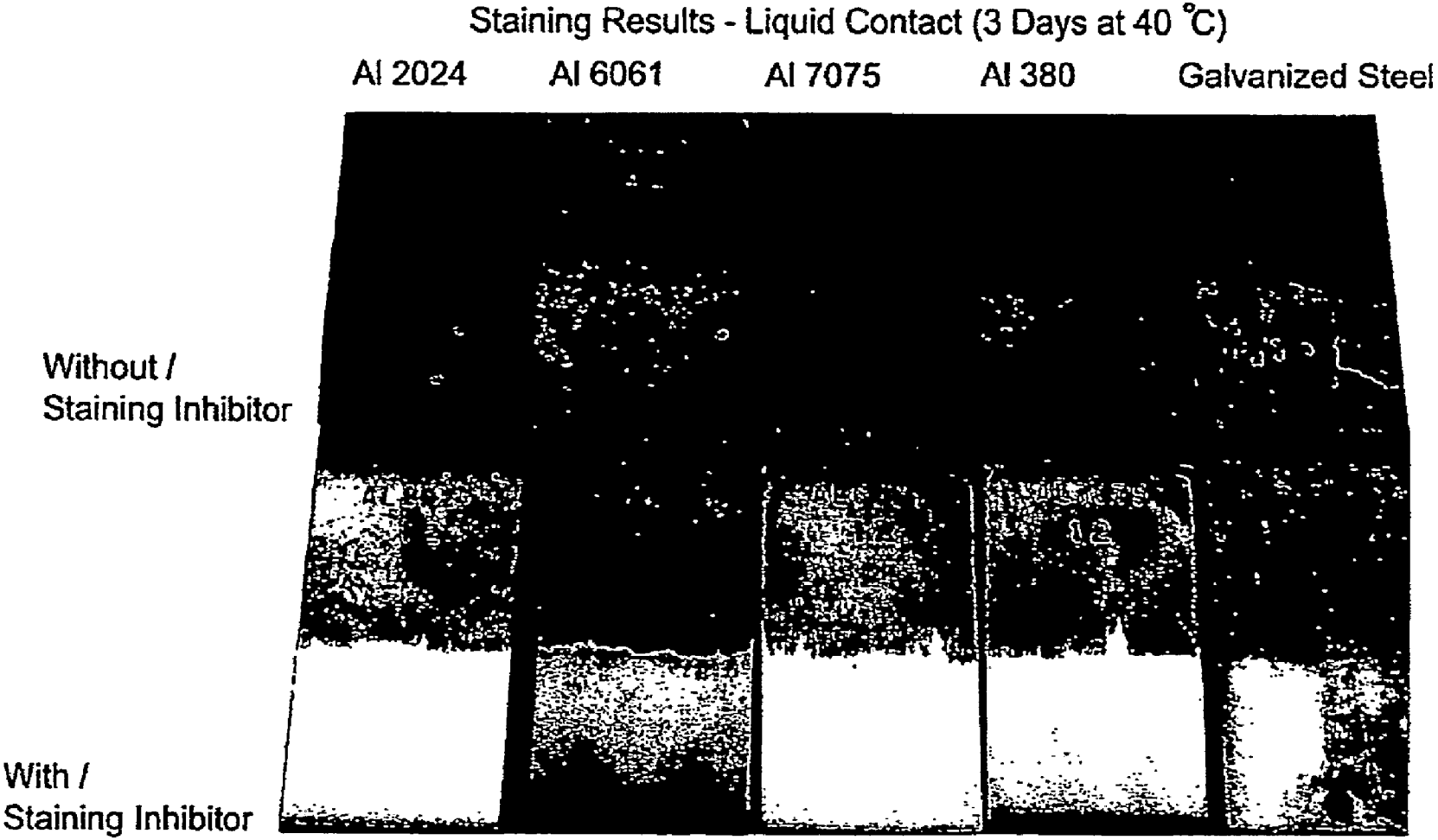
FIG. 6 is an image of aluminum alloy and galvanized steel coupons after exposure to various aqueous MWF with and without a staining inhibitor.

Staining control of selected aluminum alloy and galvanized steel coupons in pH controlled water was tested with and without 0.1 wt % of AMP Tall Oil fatty acid. FIG. 6 shows that when this salt is added to Chicago tap water (pH adjusted to 9.5 with KOH), staining is completely eliminated in the liquid phase contact areas of all coupons. Staining is not eliminated in the vapor phase areas because this salt is non-volatile.

Example 6

Various caustic neutralized fatty acids and one amine neutralized fatty acid were tested using the procedure of Example 5 above for staining of Al 2024, 380, 6061 and 7075 aluminum alloy coupons. The results are reported in the Table Ex. 6 below and in FIG. 7.

TABLE EX. 6

Staining Results of All Aluminum Alloy Coupons - Liquid Contact Weeks at 40 C.

| | NaOH | KOH | LiOH | $(CH_3)_4NOH$ |
|---|---|---|---|---|
| Tall Oil | None | None | None | None |
| Neodecanoic Acid | Not Tested | Stained | Not Tested | Not Tested |
| Isostearic Acid | Not Tested | None | Not Tested | Not Tested |

Figure 7:
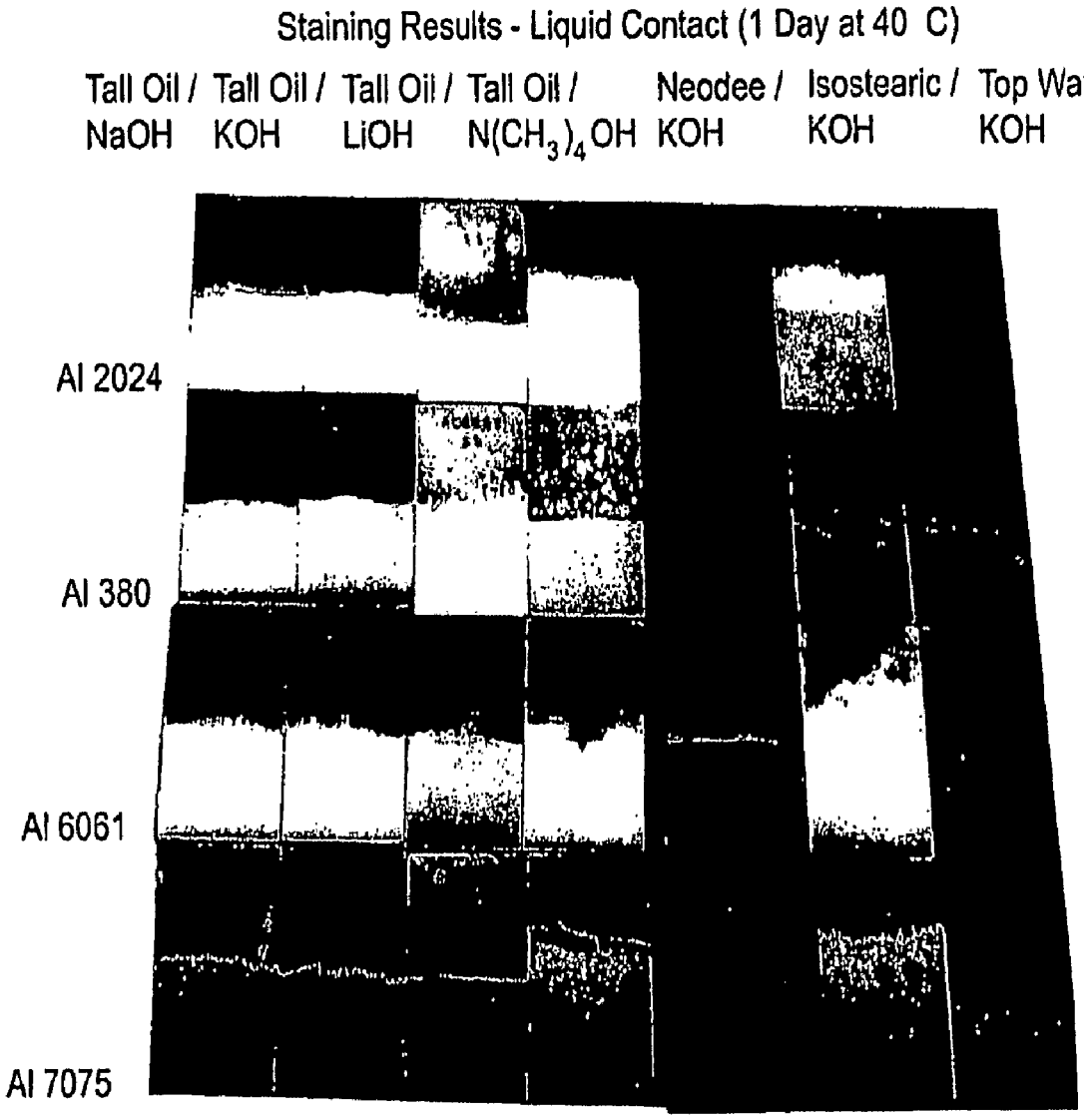
FIG. 7 shows the images of the aluminum alloy coupons reported in Table Ex. 6.

The data of Table Ex. 6 and FIG. 7 show that caustic-neutralized and amine-neutralized tall oil fatty acids of this invention are effective aluminum staining inhibitors in an aqueous MWF. The data also shows that caustic-neutralized isostearic acid is an effective aluminum staining inhibitor, but neodecanoic acid (not a fatty acid of this invention) is no more effective at inhibiting aluminum staining than its alkanolamine-neutralized counterparts.

Although the invention has been described in considerable detail, this detail is for the purpose of illustration. Many variations and modifications can be made on the invention as it is described above without departing from the spirit and scope of the invention as it is described in the following claims. All U.S. patents and allowed patent applications identified above are incorporated herein by reference.

What is claimed is:

1. A method of machining a nonferrous metal workpiece, the method comprising:

providing an aqueous metalworking fluid (MWF) consisting essentially of, based on the weight of the MWF, (i) water, (ii) from 0.1 to 1 wt % of a $C_{12-20}$ fatty acid neutralized with at least one of an amine, alkanolamine and a caustic, and optionally, (iii) one or more of hydrocarbon oils, synthetic oils, surface active agents, biocides, lubricants, dyes, defoamers and emulsifiers; and contacting a nonferrous-metal workpiece with the aqueous metalworking fluid in which the MWF has a pH between about 7 and about 10.

2. The method of claim 1 in which the workpiece is aluminum.

3. The method of claim 1 in which the fatty acid is branched.

4. The method of claim 1 in which the fatty acid is at least one of lauric acid, myristic acid, palmitic acid, stearic acid, 2-hexyldecanoic acid, oleic acid, linoleic acid, linolenic acid, arachidonic acid, ricinoleic acid, 2-cyclohexene-1-octanoic acid, 5-carboxy-4-hexyl-octanoic acid, chaulmoogric acid, isostearic acid, phytanic acid, pristanic acid, 4,8,12-trimethyltridecanoic acid and tall oil fatty acid.

5. The method of claim 1 in which the amine is at least one of ammonia, methyl-, dimethyl- and trimethylamine, ethyl-, diethyl- and triethylamine, n-propyl-, di-n-propyl- and tri-n-propylamine, isopropylamine, n-butyl-, isobutyl-, sec-butyl- and tert-butylamine, cyclohexylamine, dicyclohexylamine, benzylamine, α-phenylethylamine, β-phenylethylamine, ethylenediamine, tetramethylenediamine, tetra(methyl)ammonium hydroxide, hexamethylenediamine, aniline, methylaniline, o-, m- and p-toluidine, o-, m- and p-anisidine, o-, m- and p-chloroaniline and benzidine.

6. The method of claim 1 in which the alkanolamine is at least one of mono-, di- and triethanolamine, mono-, di- and tri-isopropanolamine, diglycolamine, n-butylethanolamine, 2-amino-2-methyl-1-propanol, and 2-amino-2-ethyl-1,3-propanediol.

7. The method of claim 1 in which the caustic is at least one of sodium hydroxide, lithium hydroxide, potassium hydroxide, a caustic alcohol, a carbonate and a phosphate.

8. The method of claim 1 in which the MWF has a pH between about 8 and about 9.5.

9. The method of claim 1 in which the MWF inhibits staining of nonferrous metal workpiece which the fluid contacts during metalworking operation.

* * * * *